US010391416B2

(12) United States Patent
Stockinger et al.

(10) Patent No.: US 10,391,416 B2
(45) **Date of Patent: *Aug. 27, 2019**

(54) START ASSIST DEVICE FOR SWIMMERS WITH POSITIONING AND REMOVAL MECHANISM

(71) Applicant: EVERLAST CLIMBING INDUSTRIES, INC., Minneapolis, MN (US)

(72) Inventors: Christian Stockinger, Loveland, CO (US); Eric Solanyk, Loveland, CO (US)

(73) Assignee: EVERLAST CLIMBING INDUSTRIES, INC., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/940,699

(22) Filed: Mar. 29, 2018

(65) Prior Publication Data

US 2018/0214789 A1 Aug. 2, 2018

Related U.S. Application Data

(63) Continuation of application No. 14/362,747, filed as application No. PCT/US2013/052900 on Jul. 31, 2013, now Pat. No. 10,245,524.

(51) Int. Cl.

| | |
|---|---|
| ***A63K 3/02*** | (2006.01) |
| ***A63B 31/00*** | (2006.01) |
| ***A63B 69/12*** | (2006.01) |

(52) U.S. Cl.

CPC ..... *A63K 3/023* (2013.01); *A63B 31/00* (2013.01); *A63B 69/12* (2013.01); *A63K 3/02* (2013.01);

(Continued)

(58) Field of Classification Search

CPC ..... A63B 5/10; A63B 31/00; A63K 3/02

(Continued)

(56) References Cited

U.S. PATENT DOCUMENTS

| | | | |
|---|---|---|---|
| 1,542,435 | A | 6/1925 | Carlson |
| 3,230,325 | A | 1/1966 | Parkinson |

(Continued)

FOREIGN PATENT DOCUMENTS

| | | | |
|---|---|---|---|
| CN | 202380776 | U | 8/2012 |
| EP | 2740518 | A2 | 6/2014 |
| WO | 2013036117 | A1 | 3/2013 |

OTHER PUBLICATIONS

International Search Report and Written Opinion for International Patent Application No. PCT/US2013/052900 dated Mar. 27, 2014, 9 pages.

(Continued)

*Primary Examiner* — Christine J Skubinna

(74) *Attorney, Agent, or Firm* — McAndrews, Held & Malloy, Ltd.

(57) ABSTRACT

An apparatus to quickly position a start assist device for backstroke swimmers and remove said start assist device once the apparatus detects or is signaled that the swimmer has left to prevent injuries and obstructions caused by the start assist device. A mechanical embodiment of such an apparatus and a motorized embodiment of such an apparatus with a data input system to position the start assist device according to the individual swimmers needs and means to signal the start event are disclosed.

16 Claims, 6 Drawing Sheets

(52) U.S. Cl.
CPC ..... *A63B 2208/03* (2013.01); *A63B 2210/50* (2013.01); *A63B 2220/833* (2013.01); *A63B 2225/093* (2013.01); *A63B 2225/50* (2013.01); *A63B 2225/60* (2013.01); *A63B 2244/20* (2013.01)

(58) Field of Classification Search
USPC ..... 4/496; 242/382.1–382.5
See application file for complete search history.

(56) References Cited

U.S. PATENT DOCUMENTS

| | | | |
|---|---|---|---|
| 3,248,069 | A | 4/1966 | Nichols |
| 3,916,214 | A | 10/1975 | Coble, Jr. et al. |
| 4,134,583 | A | 1/1979 | Davidson |
| 5,391,080 | A | 2/1995 | Bernacki et al. |
| 5,702,799 | A | 12/1997 | Brown et al. |
| 5,938,565 | A | 8/1999 | Bernacki |
| 6,773,075 | B2 | 8/2004 | Rouhana et al. |
| 7,029,170 | B2 | 4/2006 | Bailey |
| 7,644,906 | B2 | 1/2010 | Rodrigue |

OTHER PUBLICATIONS

Office Action for Chinese Application No. 2013800351694, dated Mar. 27, 2017, 7 pages.
Office Action for European Application No. 13 875 329.8-1658, dated Jun. 14, 2017, 29 pages.
PCT Patent Application No. PCT/US2013/052900 filed Jul. 31, 2013; International Preliminary Examination Report dated Feb. 11, 2016, 5 pages.
Myrtha Pools, Brochure, entitled "New Footrest System for Backstroke," 2013, 2 pages.
European Supplementary Search Report for International Application No. PCT/US2013/052900, dated Sep. 2, 2016, 7 pages.

START ASSIST DEVICE FOR SWIMMERS WITH POSITIONING AND REMOVAL MECHANISM

CROSS-REFERENCE TO RELATED APPLICATIONS/INCORPORATION BY REFERENCE

The present application is a continuation of U.S. patent application Ser. No. 14/362,747, entitled "START ASSIST DEVICE FOR SWIMMERS WITH POSITIONING AND REMOVAL MECHANISM," filed Jun. 4, 2014, which is the U.S. national phase under § 371 of International Application No. PCT/US2013/052900, having an international filing date of Jul. 31, 2013. Each of the above-mentioned prior-filed applications is hereby expressly incorporated herein by reference in its entirety.

| REFERENCES CITED | | |
|---|---|---|
| U.S. Pat. No. 4,134,583 | January 1979 | Davidson |
| Brochure | 2013 | Myrtha Pools |
| U.S. Pat. No. 5,702,799 | December 1997 | Brown et al. |

TECHNICAL FIELD

The present invention is in the field of starting assist devices for swimmers in competitive swimming and training.

BACKGROUND ART

Backstroke swimmers start their swims in the water with their backs to the swim lane, they put their feet on the pool wall or the timing touch pad should it be installed in front of the wall and they hold themselves up with handles outside the water which are provided by starting blocks. During the start preparation phase they pull themselves up and at the start signal they let go of the handles and push themselves off with their feet. An ideal start has the swimmer coming out of the water, arching back and diving back into the water in a small as possible "hole" in the water to have the least resistance. After the dive in they kick under water as far as they can before they resurface to continue the swim with their arms and feet. The stronger the start force is, the faster the swimmer starts and the further advanced he or she is compared to other swimmers in the underwater phase.

This movement sequence leads to resulting forces that the swimmer puts forth towards the pool wall or timing touch pad. In the horizontal plane the force is mostly perpendicular and moreover that angle is in control of the swimmer. In the vertical plane however there is an angle to the resulting force that is less than 90 degrees; a typical value would be 60-70 degrees. That means a substantial part of the force, the component parallel to the pool wall or timing touch pad, needs to be led into the pool wall or timing touch pad by friction.

That means swimmers encounter an acute problem of possibly slipping when they prepare for the start and then push off during the start. Therefore the fear of slipping at the critical start time prevents many swimmers from exerting their full potential force during the start which reduces performance in races and training.

Materials with high friction coefficient as described for example in U.S. Pat. No. 5,702,799 are successfully used to alleviate some of the fear and improve the start forces, but have only a limited effect.

The problem of the vertical force parallel to the pool wall or timing touch pad has been solved well by a starting assist device for backstroke swimmers as described in U.S. Pat. No. 4,134,583 by Davidson. It provides support to the feet of swimmers during the start of a swim through foot supporting means and means for positioning the foot support means which in a described preferred embodiment is a foot rest in essentially wedge form held by straps. It can be positioned to the height desired by the swimmers and be removed in less than 10 seconds. This device provides the necessary means to lead the vertical parallel force via the straps into the pool deck and thus provide a stable platform for backstroke swimming starts.

Once a swimmer has started, it is important that the starting device is removed quickly within 10 seconds or less to remove the protrusion provided by the foot rest which might injure the swimmer when coming back in the lane for a backstroke turn or which may interfere with the timing touch pad of an automated swim timing system.

In the currently known embodiments the starting device is taken out by hand by people on the pool deck such as swim officials or helpers.

The adjustment of the desired height is performed either through buckles which allow to control the length of the straps or in the case of the embodiment described in the brochure by Myrtha 2013 a bar member is hooked into the openings of a starting block containing several holes to provide closer and further distance from the pool edge, thus making the height of the foot rest adjustable within certain limits.

There are several problems with such embodiments; some of them are listed below:

- For removal of the starting assist device a person besides the swimmer is needed to remove it after the swimmer has left. If there is no person besides the swimmer available this makes the use of the device impossible, for example during training. Even if a person is available, if the device does not get removed due to lack of attentiveness, serious issues due to the protrusion as described above can result.
- In the case of the Myrtha embodiment a bar member outside the reach of a swimmer in the water of the pool needs to be positioned on a starting block. When help is lacking a swimmer can perceivably adjust the start assist device outside the pool and try the adjustment out in the pool but that is very cumbersome.
- In the case of the Davidson embodiment the straps are lengthened or shortened by buckles which is cumbersome as well. In a race or training environment with many swimmers, where every swimmer needs to adjust the position to their individual needs this is a serious shortcoming.

The current invention targets one or more of said problems.

DISCLOSURE OF THE INVENTION

To improve the above described problems the following preferred embodiments of a device are described. The device provides positioning means for the foot rest, for example straps, which are connected to an apparatus outside the pool, preferably on the pool deck, which allows for easy adjustment to the desired height by the swimmer and detection when the swimmer has left to then automatically shorten the straps in order to remove the footrest from the pool or lengthen the straps in order to move the footrest down to the bottom of the pool.

One preferred embodiment provides a winding tube in an enclosure around which the straps of the footrest are wound. The spooling tube contains a torsion spring and is connected to a ratchet with a removable lock. The whole apparatus is securely mounted on the pool deck, for example by being fastened to the starting block, the gutter or bolted into the pool deck.

When a swimmer uses the device he or she opens the lock to free the ratchet, pulls down the foot rest to the individually desired height, thus unwinding the straps and winding up the torsion spring. He or she then closes the lock of the ratchet while holding the footrest and puts his or her feet on the foot rest. The lock in the ratchet prevents any further extension of the straps, thus holding the foot rest in position, as long as the holding force of the feet is stronger than the recoil force of the torsion spring. Then he or she performs a start, exuding full force without the fear of slipping vertically from the pool wall, being supported by the foot rest which is held securely by the locked ratchet. After he or she leaves the foot rest the device detects that the swimmer has left because the holding force vanishes and the recoil force of the torsion spring turns the spooling tube, thus winding up the straps. The spooling tube and the ratchet turn, the lock clicks into the ratchet teeth thus slowing down the winding speed, which is a desired effect. After a few seconds the straps are wound up fully, the foot rest comes to a halt at the outside of the device and is ready for the next swimmer.

Other embodiments of the apparatus contemplated include a motorized winch to control the length of the positioning means. The motor is connected to a power supply and a motor control data processing system with data inputs to control the winding, holding and unwinding of the motor and thus the length of the straps, which in turn controls the position of the foot rest.

The data interface can accept information through manual input or through an electronic data interface which is connected to another, external data processing system such as an automated swimming system or a computer with a meet manager application.

Means to detect the status of the apparatus are arranged and connected to the motor data processing system. They detect if a swimmer is on the device, is starting, has left the device and the position the foot rest.

A means to detect if a swimmer is on the device, is starting or has left the device can be a torque measurement system integrated into the winch to measure holding forces, start forces or if the forces of the swimmer have vanished. Depending on the state, the motor holds when the swimmer is on the device or when the swimmer starts, and moves the positioning means when the device detects that the swimmer has left. Other contemplated embodiments for the detection are force detectors on the foot supporting means or on the positioning means, detectors if the feet of the swimmer are on the foot supporting means or such. Together with the known position of the foot rest the apparatus allows for a meaningful positioning of the foot rest during all states of use.

In other embodiments a person watches and detects if one, several or all swimmers in a pool have left and who gives a signal or several signals to the apparatus or to the plurality of apparatuses to change the position of the foot supporting means once a swimmer, several or all swimmers have left.

Other embodiments use the timing touch pad on the pool wall and the swim timing system to detect when the swimmer has left. One embodiment is that the timing touchpad will be pressed by the perpendicular holding forces and start forces of the swimmer, which will cause the timing touchpad to create a signal. Once the swimmer has left the timing touch pad will cease to create a signal and the attached swim timing system can send a "swimmer has left" signal to the apparatus. Since the swim timing system has knowledge of the start signal as well it is particularly suited to generate a signal to the apparatus that the swimmer has left and that the foot rest can be removed.

Other embodiments infer the detection that the swimmer has left by including the start signal into the apparatus. The external timing system carrying the start signal is connected through the data input to the motor control system or a means to detect the audible start signal and/or a means to detect the visible start signal are connected to the motor control data processing system. Once the start signal is detected, after a delay time (for example 6 seconds), the position of the foot rest is changed. In these embodiments a safety means needs to be employed, for example a weak positioning force of the apparatus or an additional detection mechanism as described above, to ensure that a swimmer who has missed the start signal and is still on the foot rest after the delay time will not be injured or startled by the attempt of the apparatus to position the foot rest.

The process of use of the apparatus begins with the foot rest being out of the way of the swimmer, for example wound up on the pool deck or wound down to the pool bottom. The swimmer approaches the apparatus and either inputs the desired positioning information himself, for example "½ inch below the water surface", or said information is transmitted from an external data processing system with knowledge who the swimmer is and what positioning value he or she needs. In the next step the motor sets the desired position of the foot rest. The swimmer mounts the foot rest and starts, the detection mechanism detects or the start signal reports to the motor control data information system the mounting state and the start state. During both preceding states the motor holds. Once the swimmer has left, the detection mechanism reports this state to the motor control data processing system or the delay time elapses and with the help of said positioning means the motor moves the foot rest out of the way of the swimmer as described above.

In the case of mounting the device onto starting blocks with a single post there is the possibility that the vertical forces through the straps are not exactly the same by either the swimmer not being perfectly located in the center of the foot rest between the straps or by exuding different forces with the legs. This results in a turning of the device and a vertical slipping of the foot rest on the side with the higher force. To prevent this effect the device can be connected via a bar to a like device next to it, which in essence provides a second mounting point, which leads to stable footrests on both devices. This system can be extended to more than two devices, for example to eight located at the eight lanes of a swimming pool, thus leading to stable mounting of them all.

BEST MODE FOR CARRYING OUT THE INVENTION

Figure 1A:
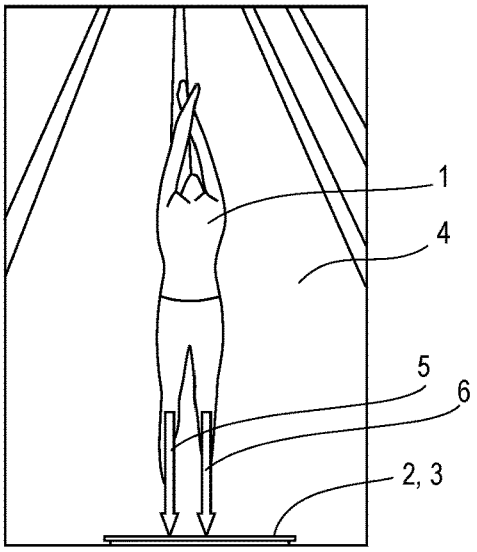
FIG. 1A is a top view of a starting backstroke swimmer with the projection of the start forces shown.

FIG. 1A shows a top view (photo credit pinterest.com) of a starting backstroke swimmer 1 in the water 4 with the start force projection of the right leg 5 and the start force projection of the left leg 6 drawn into the picture. The start forces 5 and 6 in the horizontal plane are essentially perpendicular to the timing touch pad 2 and pool wall 3. As soon as the swimmer has left the start assist device it needs to be removed from the timing touch pad 2 and the pool wall 3 so that a swimmer who comes back in his or her lane does not hurt him- or herself on the protrusion while doing a backstroke turn or reaching the wall and that a timing touch pad 2 is not obstructed to register a touch signaling the end of a race.

Figure 1B:
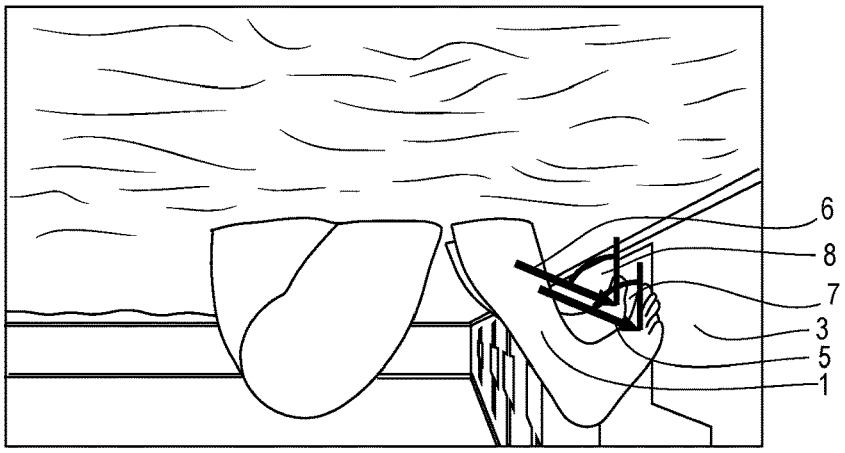
FIG. 1B is an underwater side view of a backstroke swimmer preparing for a start with the projection of the start forces shown, showing the angles and the vertical start forces.

FIG. 1B shows the underwater side view (photo credit Goswim.tv) of a starting swimmer with the projection of the start forces 5 and 6 drawn into the picture. The start forces 5 and 6 are at angles 7 and 8 of less than 90 degrees to the pool wall 3 (no timing touch pad 2 is installed in this picture), which results in a vertical component of the start force 10 as described in FIG. 1C.

Figure 1C:
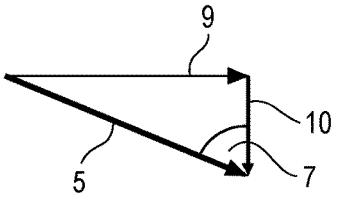
FIG. 1C is a force diagram of FIG. 1B showing the vertical and horizontal components of one start force, for example the force of the right leg.

FIG. 1C is a force triangle of the resultant start force of the right leg 5 at the angle 7 resulting in a perpendicular force component 9 and a vertical force component 10. The vertical force component 10 parallel to the pool wall 3 provides the danger of slipping if only transferred into the pool wall 3 by friction.

Figure 1D:
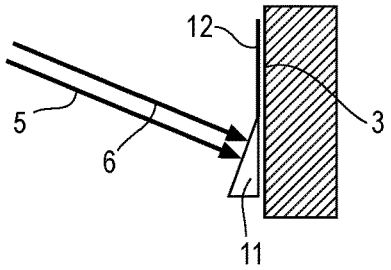
FIG. 1D shows how the forces of the right and left leg are transferred into a start assist device.

FIG. 1D shows the start force of the right leg 5 and the start force of the left leg 6 going into a backstroke start assist device foot rest 11 with straps 12, thus preventing slipping in vertical direction on the pool wall 3. The device bears the vertical force components of the resultant start forces 5 and 6 which come through the straps and transfers them into the pool deck. The perpendicular components are transferred directly into the pool wall 3 or timing touchpad 2.

Figure 2:
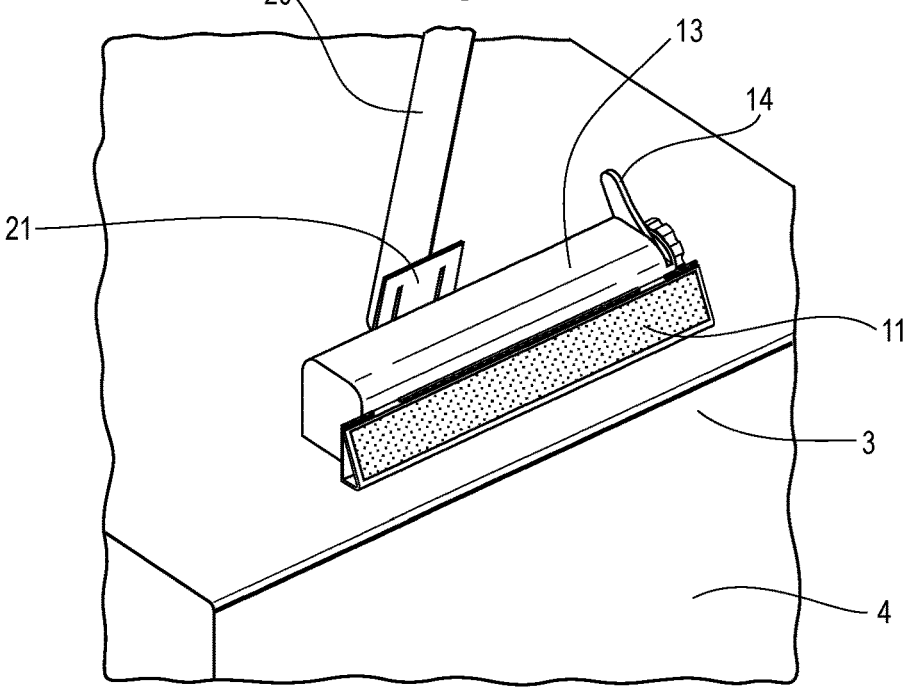
FIG. 2 shows the device in perspective view with wound up foot rest and closed lock.

FIG. 2 shows a preferred embodiment of the present invention 13 with the foot rest 11 in the fully removed position from the water 4, thus clearing the pool wall 3 (or a timing touch pad 2, here not shown) from the protrusion of the foot rest 11. It further shows the lock 14 in closed position and an example of a post of a starting block 20 and a mounting bracket 21 mounted to the device 13, which connects the device 13 through means such as Velcro hook and loop fasteners to the post of the starting block 20.

Figure 3:
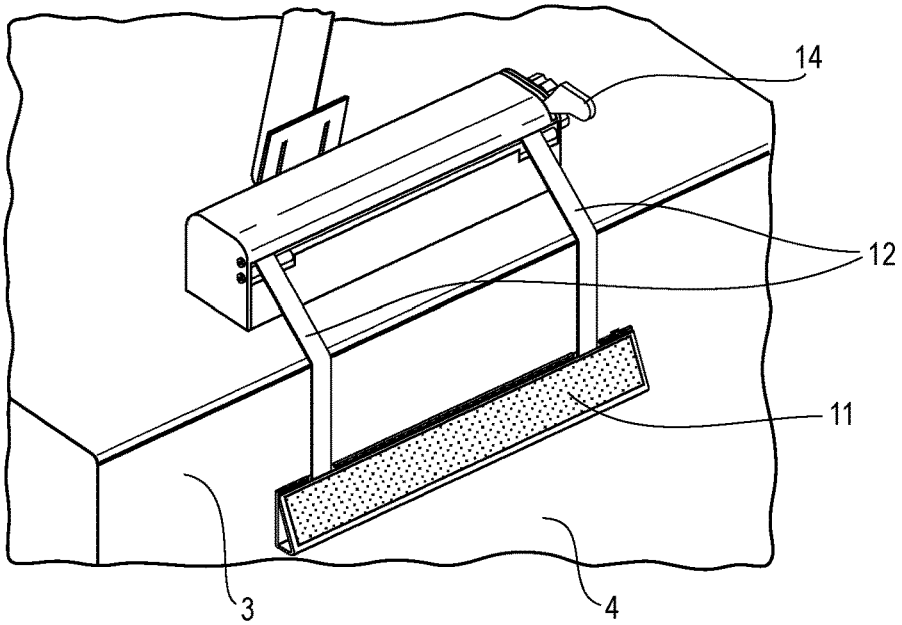
FIG. 3 shows the device in perspective view with wound down foot rest and open lock.

FIG. 3 shows a preferred embodiment of the present invention with the lock 14 in the open position and the foot rest 11 pulled down into the water 4 which exposes the positioning means, for example straps 12. In this position the footrest 11 creates a protrusion on the pool wall 3.

Figure 4:
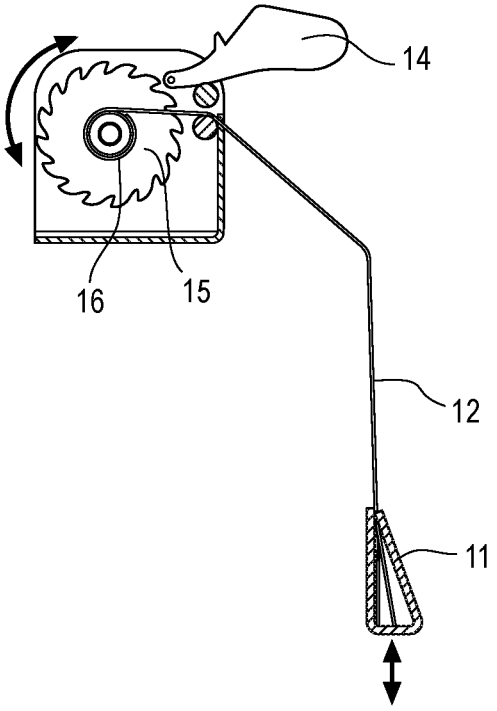
FIG. 4 shows a sectional view of the device showing the wound down footrest, the ratchet and the open lock during the positioning process.
Figure 7:
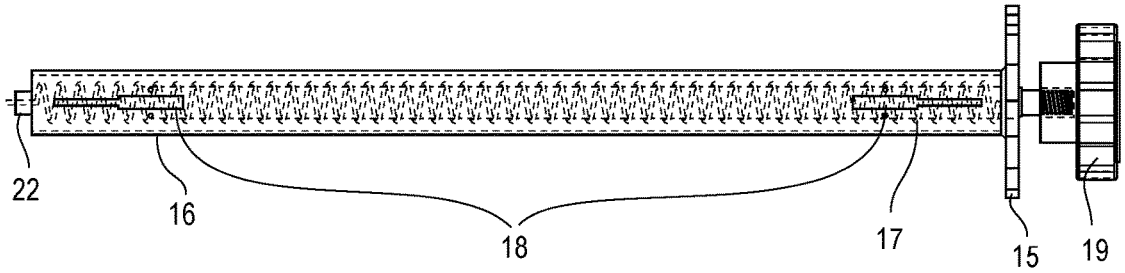
FIG. 7 shows the winding tube with ratchet and torsion spring.

FIG. 4 shows that with the open lock 14 the ratchet 15 can turn in either direction, thus allowing the straps 12 to wind or unwind on the winding tube 16 which leads to different positions of the foot rest 11 relative to the water level, as individually desired by the swimmer. The positioning process can be accomplished quickly either by pulling more or less on the footrest 11 or by manually turning the wheel 19 as shown in FIG. 7. It needs to be noted that according to FIG. 7 inside the winding tube 16 a torsion spring 17 or a similar means is located which winds up when the straps become unwound from the winding tube 16. That creates a pulling force on the foot rest 11 which the swimmer has to overcome during the positioning process to inform the device that he or she is present.

Figure 5:
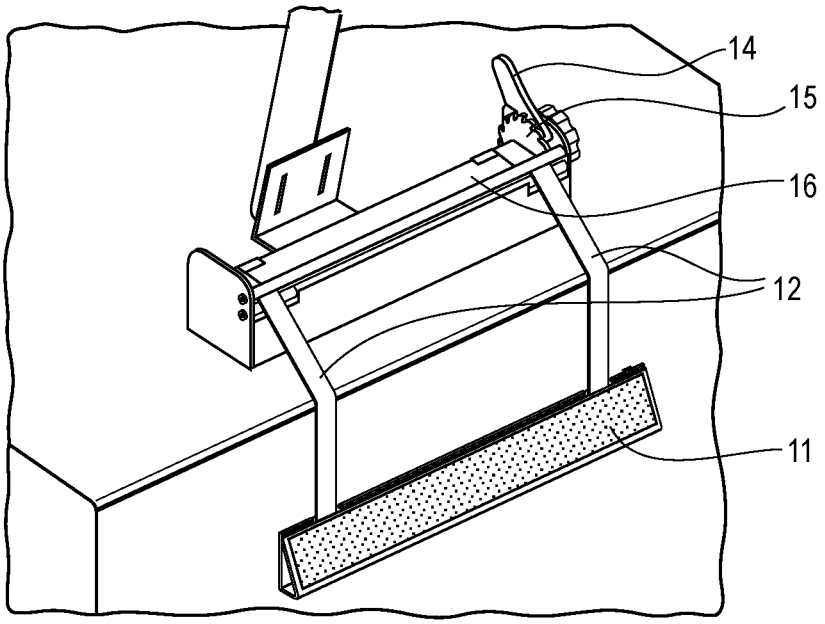
FIG. 5 shows the device in perspective view without cover with closed lock.

FIG. 5 shows the device without the protective cover to expose the functions inside. Once the foot rest 11 is positioned at the desired height, the swimmer has to hold it down against the winding force of the torsion spring 17 and flip the lock 14 into the closed position to lock the ratchet 15. That prevents the winding tube 16 from further unwinding the straps 12. The swimmer can then put his or her feet on the foot rest 11 and as long as the holding force of the swimmer on the foot rest is larger than the rewinding force the device recognizes that the swimmer is present and the position of the footrest 11 stays in place. In this position the swimmer can perform a start without the fear of slipping because the vertical forces 10 are transferred from the foot rest 11 through the straps through the locked ratchet 15 into the device into the pool deck.

Figure 6:
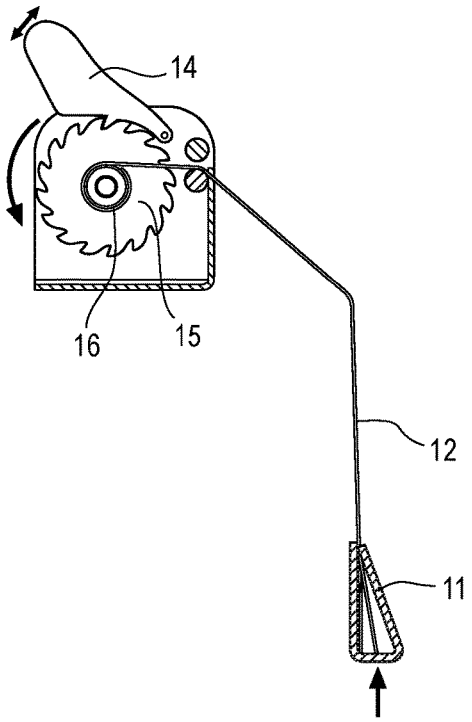
FIG. 6 shows a sectional view of the device showing the closed lock and the device rewinding.

FIG. 6 shows that once the swimmer has left the footrest 11, the holding force of the swimmer on the foot rest is removed, the device recognizes that the swimmer is not present and the rewind force of the torsion spring 17 causes the ratchet 15 with the winding tube 16 to turn in the indicated direction that the lock allows. The lock 14 clicks from one ratchet tooth into the next ratchet tooth which slows down the turning speed of the ratchet, a desired effect to control the speed of the rewinding process. The straps 12 are wound up and the footrest 11 is pulled out of the water 4 away from the pool wall 3. The end position of the device is the same as shown in FIG. 2, where the straps 12 are completely wound up on the winding tube 16 up by the force of the torsion spring 17 and the footrest 11 is completely removed from the pool wall 3.

The wound up position of FIG. 2 allows the swimmer to do backstroke turns or hit a timing touchpad to end a race without interference of the foot rest 11.

FIG. 7 shows the details of the winding tube 16 with the attached ratchet 15 and hand wheel 19. The hand wheel 19 is an additional means to manually wind up the winch should a failure occur or to manually position the foot rest. Inside the tube is the torsion spring 17 which is connected to the winding tube assembly on the side with the ratchet 15. In the assembled device 13 the axle 22 goes through the chassis of the device. The other side of said torsion spring 17 is affixed to the chassis so that when the winding tube assembly is turned the torsion spring becomes either wound or unwound, thus creating the winding force to position the footrest 11.

Figure 8:
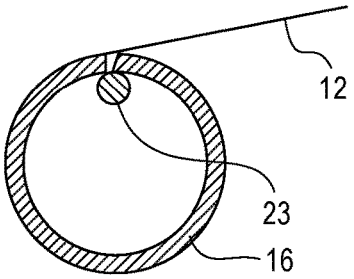
FIG. 8 shows the winding tube in a sectional view with the inserted strap end to affix the strap.

FIG. 8 shows a preferred embodiment of how the straps 12 are affixed to the winding tube 16. The straps 12 have a small bar 23 or such affixed, for example sewn in, to the effect that the thickness of the strap is locally increased. This thicker part is inserted into the winding tube 16 through the wider part of one of the openings 18 and then pushed towards the narrower part of the opening. This effectively locks the strap in place to bear the winding forces. The wider part of the openings 18 are then covered to prevent the straps from wandering back out through the wider part of the openings during operation.

Figure 9:
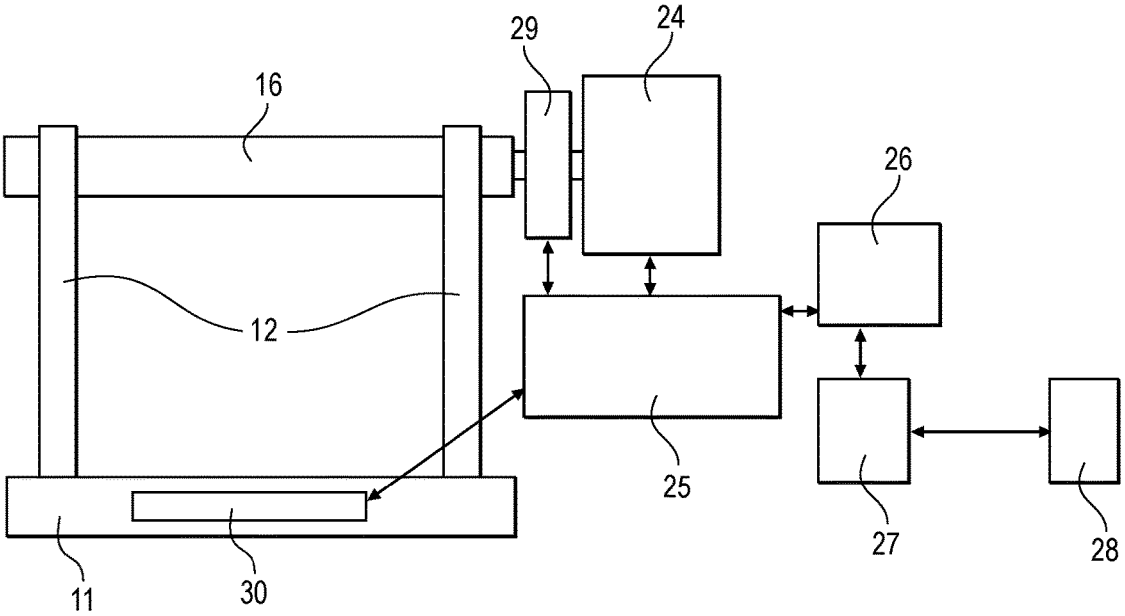
FIG. 9 shows a motorized apparatus with its control components.

FIG. 9 shows another preferred embodiment of the apparatus contemplated, including a motorized winch to control the length of the positioning means. The motor 24 is connected to the winding tube 16 and to a power supply (not shown) and a motor control data processing system 25 with inputs described below to control the winding, holding and unwinding of the motor 24 and thus the length of the positioning means 12, which in turn controls the position of the foot supporting means 11.

A data interface 26 to communicate the information about the individual positioning of the foot rest 11 is connected to the motor control data processing system 25. The data interface can accept information by manual input or through an electronic data interface 27 to another, external data processing system 28 such as an automated swimming system or a computer with a meet manager application via data channels known in the art such as serial data lines, CAN bus, USB, wireless data lines or other embodiments of such data channels, and can display the status of the device for example with LEDs. Thus the positioning information of an individual swimmer can be transmitted to the motor 24 either manually for example by the swimmer or automatically through the connected external data processing system 28.

Means to detect the status of the apparatus are arranged and connected to the motor data processing system. They detect if a swimmer is on the device, is starting, has left the device and the position of the foot supporting means.

A preferred embodiment to detect if a swimmer is on the device, is starting or has left the device is a torque measurement system 29 integrated into the winch as known in the art which detects if the swimmer exudes holding forces, start forces or if the holding forces have vanished. Depending on the state the motor 24 holds when the swimmer is on the device or starts and winds the positioning means 12 when it detected that the swimmer has left. Other contemplated embodiments are force detectors on the foot supporting means 11 or on the positioning means 12, detectors 30 if the feet of the swimmer are on the foot supporting means 11 or such.

Means to detect the position of the foot supporting means 11 such as a step counter in the motor control in conjunction with an end detector of the positioning means 12, a length measurement of the positioning means 12 such as marks in the positioning means or such are connected to the motor control data processing system 25 to allow a meaningful positioning of the foot supporting means 11.

The motor control data processing system 25 takes all the inputs and processes them to control the position of the foot supporting means 11 during the various states of the apparatus. The process starts with the foot supporting means 11 being out of the way of the swimmer, for example wound up on the pool deck or wound down to the pool bottom. The swimmer approaches the apparatus and either inputs the desired positioning information himself or herself into the data interface 26, for example "½ inch below the water surface", or said information is transmitted from an external data processing system 28 with knowledge who the swimmer is and what positioning value he or she needs. In the next step the motor 24 sets the desired position of the foot supporting means 11. The swimmer mounts the foot supporting means 11, the detection mechanism 29 or 30 detects and reports to the motor control data information system the mounting state. The swimmer starts and the detection mechanism 29 or 30 detects and reports to the motor control data processing system 25 the starting state. During both preceding states the motor 24 holds the foot supporting means 11 steady. Once the swimmer has left, the detection mechanism reports this state to the motor control data processing system 25 and the motor 24 positions with the help of said positioning means 12 the foot supporting means 11 out of the way of the swimmer as described above.

Figure 10:
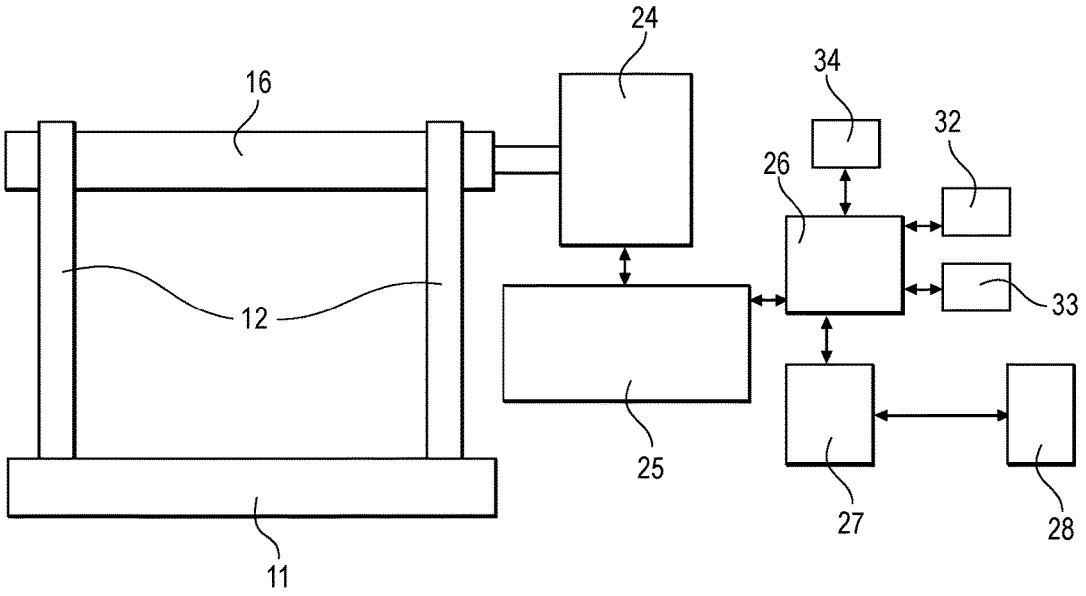
FIG. 10 shows a motorized apparatus with various detection components.

FIG. 10 shows a motorized device with a detection unit for a start tone 32, a detection unit for a visual start signal 33, the input from the external timing system 28 to signal a start event and a manual input unit 34. Either of the detection unit 32 or the detection unit 33 or both, or a signal from the external timing system 28 can be used to signal the motor control unit 25 that the start has occurred, that the swimmer is not expected to be present anymore after a delay time (for example 6 seconds) and therefore the motor 24 can move the positioning means 12 by turning the winding tube 16 to remove the foot supporting means 11 after that delay time. In the case of an inferred detection it is advisable to have safety means in place to prevent injury or startling of the swimmer by suddenly and unexpectedly moving the foot supporting means. The safety means could be detection means as shown in FIG. 9. Their signals would let the motor hold the foot supporting means 11 in place as long as they detect a swimmer, overriding a start signal or positioning signal to the motor. A manual input 34, operated by a person, can be used to signal to the motor control data processing system 25 that the swimmer is not present anymore, either because of a start or for any other reason, and the motor 24 can remove the foot supporting means 11 through the positioning means 12. A signal from a timing touchpad 2 connected to a swim timing system 28 can be used to determine when a swimmer has left. In one embodiment the timing touchpad 2 gets pressed by the foot supporting means 11 as long as the swimmer exudes forces during the holding and starting phase, and the signals from said timing touchpad 2 get processed by the swim timing system 28 which in turn sends a command to move the foot supporting means 11 through the interface 27 to the apparatus.

Figure 11:
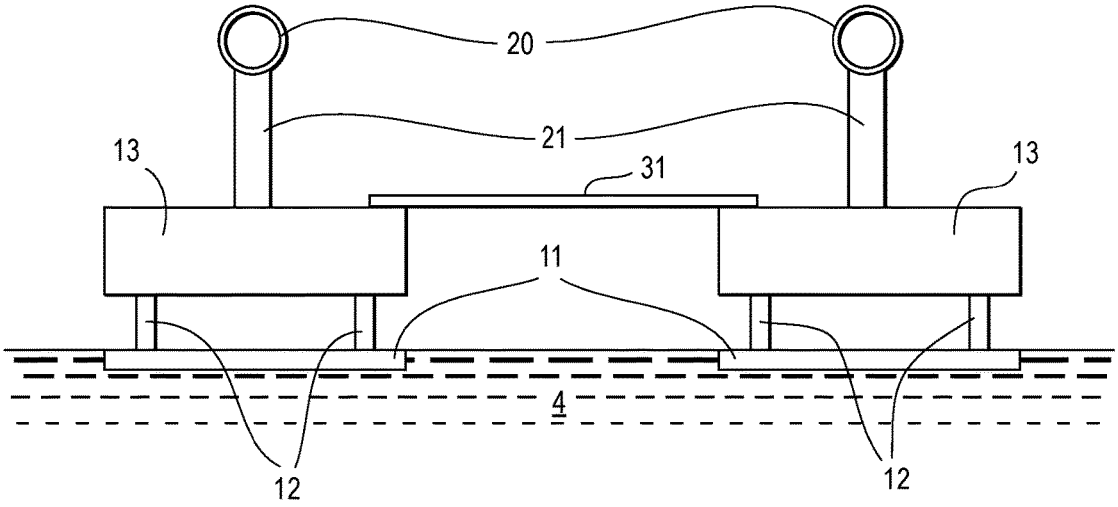
FIG. 11 shows two devices mounted on a pool deck, affixed on starting block posts and connected together with a bar.

FIG. 11 shows two devices 13 mounted on a pool deck, close to the edge of the deck and with the foot supporting means 11 hanging into the water 4 via the positioning means 12. In this example each of them is connected through a bracket 21 to the post 20 of a starting block. Both devices are connected through a bar 31 to provide a stable mounting, should the forces of a swimmer coming through the positioning means 12 not be exactly equal. The bar 31 creates for each device in essence two mounting points which prevents a turning or swaying of a device 13, which would lead to a slipping of a foot supporting means 11.

The disclosed embodiments are representative of presently preferred forms of the invention, but are understood to be illustrative rather than definitive of the invention.

The invention claimed is:

1. A starting assist apparatus for assisting backstroke swimmers during a start process, the apparatus comprising:

a footrest operable for positioning in a pool during the start process and automatic removal from the pool after the start process, wherein the positioning in the pool corresponds with an extended position of the footrest and the automatic removal from the pool corresponds with a retracted position of the footrest;

a rotatable winding tube comprising a torsion spring configured to provide a bias force to the rotatable winding tube in a first direction corresponding with the retracted position of the footrest;

a plurality of straps coupling the footrest to the rotatable winding tube, the plurality of straps configured to simultaneously wind around the rotatable winding tube if the rotatable winding tube is rotated in the first direction, the plurality of straps configured to simultaneously unwind from the rotatable winding tube if the rotatable winding tube is rotated in the second direction, wherein:

a force applied to the rotatable winding tube in a second direction that exceeds the bias force provided by the torsion spring in the first direction rotates the rotatable winding tube in the second direction to simultaneously unwind the plurality of straps to move the footrest to the extended position, and the bias force provided by the torsion spring in the first direction automatically and simultaneously winds the plurality of straps on the rotatable winding tube to move the footrest to the retracted position in an absence of the force applied to the rotatable winding tube in the second direction that exceeds the bias force provided by the torsion spring in the first direction; and a lock operable to receive a user actuation to a closed position to set the extended position of the footrest in the pool at a user-selected position, wherein the user actuation of the lock to the closed position prevents rotation of the winding tube in the second direction to unwind the plurality of straps and allows rotation of the winding tube in the first direction to wind the plurality of straps.

2. The apparatus according to claim 1, wherein the lock is configured to allow rotation of the rotatable winding tube in the first direction and the second direction to respectively wind and unwind the plurality of straps if the lock is in an open position.

3. The apparatus according to claim 1, wherein the rotation of the rotatable winding tube in the first direction to automatically and simultaneously wind the plurality of straps is slowed by the lock if the lock is in the closed position.

4. The apparatus according to claim 3, comprising a ratchet coupled to the rotatable winding tube and configured to interface with the lock.

5. The apparatus according to claim 4, wherein the ratchet comprises a plurality of teeth, and wherein the lock slows the rotation of the rotatable winding tube by clicking into the plurality of teeth of the ratchet as the rotatable winding tube rotates in the first direction to automatically and simultaneously wind the plurality of straps.

6. The apparatus according to claim 1, wherein:

the rotatable winding tube comprises a plurality of openings, each of the openings comprising a narrow opening portion contiguous with a wider opening portion, and each of the plurality of straps comprises an attachment mechanism configured for insertion into the wider opening portion and sliding to the narrow opening portion of one of the plurality of openings of the rotatable winding tube to couple each of the plurality of straps to the rotatable winding tube.

7. The apparatus according to claim 1, comprising a wheel coupled to the rotatable winding tube configured to manually rotate the rotatable winding tube in one or both of the first direction and the second direction.

8. The apparatus according to claim 1, comprising a mounting bracket configured to mount the apparatus to a post of a starting block.

9. A plurality of starting assist apparatuses for assisting backstroke swimmers during a start process, each of the plurality of starting assist apparatuses comprising:

a footrest operable for positioning in a pool during the start process and automatic removal from the pool after the start process, wherein the positioning in the pool corresponds with an extended position of the footrest and the automatic removal from the pool corresponds with a retracted position of the footrest;

a rotatable winding tube comprising a torsion spring configured to provide a bias force to the rotatable winding tube in a first direction corresponding with the retracted position of the footrest;

a plurality of straps coupling the footrest to the rotatable winding tube, the plurality of straps configured to simultaneously wind around the rotatable winding tube if the rotatable winding tube is rotated in the first direction, the plurality of straps configured to simultaneously unwind from the rotatable winding tube if the rotatable winding tube is rotated in the second direction, wherein:

a force applied to the rotatable winding tube in a second direction that exceeds the bias force provided by the torsion spring in the first direction rotates the rotatable winding tube in the second direction to simultaneously unwind the plurality of straps to move the footrest to the extended position, and the bias force provided by the torsion spring in the first direction automatically and simultaneously winds the plurality of straps on the rotatable winding tube to move the footrest to the retracted position in an absence of the force applied to the rotatable winding tube in the second direction that exceeds the bias force provided by the torsion spring in the first direction; and a lock operable to receive a user actuation to a closed position to set the extended position of the footrest in the pool at a user-selected position, wherein the user actuation of the lock to the closed position prevents rotation of the winding tube in the second direction to unwind the plurality of straps and allows rotation of the winding tube in the first direction to wind the plurality of straps, wherein each of the plurality of starting assist apparatuses is coupled to one or more other of the plurality of starting assist apparatuses by a bar.

10. Each of the plurality of starting assist apparatuses according to claim 9, wherein the lock is configured to allow rotation of the rotatable winding tube in the first direction and the second direction to respectively wind and unwind the plurality of straps if the lock is in an open position.

11. Each of the plurality of starting assist apparatuses according to claim 9, wherein the rotation of the rotatable winding tube in the first direction to automatically and simultaneously wind the plurality of straps is slowed by the lock if the lock is in the closed position.

12. Each of the plurality of starting assist apparatuses according to claim 11, comprising a ratchet coupled to the rotatable winding tube and configured to interface with the lock.

13. Each of the plurality of starting assist apparatuses according to claim 12, wherein the ratchet comprises a plurality of teeth, and wherein the lock slows the rotation of the rotatable winding tube by clicking into the plurality of teeth of the ratchet as the rotatable winding tube rotates in the first direction to automatically and simultaneously wind the plurality of straps.

14. Each of the plurality of starting assist apparatuses according to claim 9, wherein:

the rotatable winding tube comprises a plurality of openings, each of the openings comprising a narrow opening portion contiguous with a wider opening portion, and each of the plurality of straps comprises an attachment mechanism configured for insertion into the wider opening portion and sliding to the narrow opening portion of one of the plurality of openings of the rotatable winding tube to couple each of the plurality of straps to the rotatable winding tube.

15. Each of the plurality of starting assist apparatuses according to claim 9, comprising a wheel coupled to the rotatable winding tube configured to manually rotate the rotatable winding tube in one or both of the first direction and the second direction.

16. Each of the plurality of starting assist apparatuses according to claim 9, comprising a mounting bracket configured to mount the apparatus to a post of a starting block.

* * * * *